US005769742A

United States Patent [19]

Bristow

[11] Patent Number: 5,769,742

[45] Date of Patent: Jun. 23, 1998

[54] MECHANICAL ATHLETIC TRAINING DEVICE

[76] Inventor: Ron Bristow, 5367 - 36A Street, Innisfail, Alberta, Canada, T4G 1E6

[21] Appl. No.: 772,927

[22] Filed: Dec. 24, 1996

[51] Int. Cl.[6] ..... A63B 69/00

[52] U.S. Cl. ..... 473/446

[58] Field of Search ..... 473/446

[56] References Cited

U.S. PATENT DOCUMENTS

| | | | |
|---|---|---|---|
| 2,824,742 | 2/1958 | Fortin . | |
| 3,709,489 | 1/1973 | Holieran . | |
| 3,765,675 | 10/1973 | Dimarzio | 473/446 |
| 4,489,940 | 12/1984 | Amundson . | |
| 5,160,138 | 11/1992 | Sanders | 473/438 |
| 5,449,170 | 9/1995 | Clements . | |
| 5,498,000 | 3/1996 | Cuneo | 473/471 |
| 5,527,185 | 6/1996 | Davis | 473/438 |

FOREIGN PATENT DOCUMENTS

| | | |
|---|---|---|
| 2033869 | 7/1991 | Canada . |

*Primary Examiner*—William H. Grieb

*Attorney, Agent, or Firm*—Arthur A. Gardner & Associates, P.C.

[57] ABSTRACT

A mechanical athletic training device includes a mobile carriage with a locking device which locks the mobile carriage in a stationary position. An opponent simulator, such as a hockey stick, is connected to the mobile carriage by a pivoting connection. The mobile carriage combined with the pivoting connection allows the opponent simulator to interact with an athlete by simulating the movements and actions of a defensive or offensive player. The mobile carriage combined with the pivoting connection forces the athlete to anticipate the movements of the opponent simulator and play through the opponent simulator rather than around it. The opponent simulator can be activated manually by the athlete by striking the opponent simulator. Alternatively, the opponent simulator can be manually operated by an operator using a handle device attached to the pivoting connection. As a further alternative, an electric motor can be attached to the pivoting connection to automatically impart motion to the opponent simulator.

17 Claims, 6 Drawing Sheets

MECHANICAL ATHLETIC TRAINING DEVICE

FIELD OF THE INVENTION

The present invention relates to mechanical athletic training devices and is particularly concerned with mechanical athletic training devices which simulate the defensive and offensive movements of opposing players.

BACKGROUND OF THE INVENTION

Unlike sports such as football, where players block their opponents and are forced to play around their opponents, hockey, soccer, lacrosse and the like demand additional skills whereby the player must be able to play, not only around his or her opponent, but "through" his or her opponent as well. Generally this is accomplished by the player maneuvering the object of play through the opposing player's legs, moving around the opposing player and then regaining control of the object of play. Furthermore, hockey and lacrosse provide the extra challenge of requiring the use of a "tool" such as a hockey stick or lacrosse stick to play the game. In defensive play, the "tool" is used by the player to take the object of play, such as the hockey puck or lacrosse ball, from the opposing player or to attempt to foul the opposing player's moves. In offensive play, the "tool" is used by the player to maneuver the object of play around or through the opponents and to the goal. In the game of hockey, as one example, this skill is known as "stick handling". In order to perfect a player's "stick handling" skills, it is necessary for the player to be able to successfully anticipate the defensive movements and learn how to play "through" an opposing player and then learn how to regain control of the hockey puck. Athletes training for the sport of hockey, as one example, train and perfect their skills by engaging in repetitive exercises known as "drills". Training devices, such a blocking simulators, are often employed. However, there are no training devices which can effectively simulate the stick handling skills of an opposing player in order to train athletes to counter these skills.

One example of a blocking device which has an application in the sport of hockey is U.S. Pat. No. 5,160,138 entitled "ATHLETIC TRAINING DEVICE" and issued to Thomas E. Sanders on Nov. 3, 1996. The Sanders device is shown in FIG. 1 herein. Sanders discloses a training device which is capable of following the lateral movements of a player. The Sanders device is designed to offer the athlete the actions of a simulated opposing player who is attempting to block or foul his or her shot. The player is harnessed to the Sanders apparatus and therefore is restricted in his or her ability to use his or her agility, stick handling and passing skills to overcome the obstacle. Furthermore, the Sanders device is further limited in that, for all its complexity, it does not allow the athlete to fully utilize his or her sporting skills as the athlete is allowed only to attempt to pass the object of play around the obstacle. Sanders does not teach an apparatus which would train the athlete in the necessary stick handling skills which would allow a player to play through an opponent.

Another example of a stationary shot blocking device is that disclosed in U.S. Pat. No. 5,527,185 entitled "ATHLETIC TRAINING DEVICE" issued to Timothy J. Davis on Jun. 18, 1996. The Davis device discloses many of the same limitations as Sanders and does not provide for the simulation of an opposing player's defensive or offensive movements.

A third example of prior art pertaining to the sport of hockey is that disclosed in U.S. Pat. No. 5,498,000 entitled "GOALTENDER SIMULATOR SYSTEM" issued to Gregory Cuneo on Mar. 12, 1996.

Cuneo discloses a sophisticated computer-aided goal tender simulator which, through the use of cameras and proximity sensors, attempts to provide the player with a realistic goal tender capable of anticipating the trajectory of a hockey puck in flight. While Cuneo demonstrates the marriage of advanced computer and optical technologies to the game of hockey, it does not provide for the simulation of a defensive or offensive hockey player. As well, the cost of purchasing and installing such a system would be prohibitive to most hockey clubs and arenas outside of the professional leagues.

Therefore, the prior art devices described above generally are not suitable for interacting with an athlete in a defensive or offensive posture and none are suitable to train an athlete in stick handling skills. Furthermore, the prior art devices generally do not allow the athlete to fully utilize all of his or her skills in attempting to overcome the obstacle presented by the these training devices. Finally, the sophistication and hence cost of the prior art patents described herein make their wide spread use prohibitive.

Hence, there is a need to provide a mechanical athletic training device which avoids the above-mentioned disadvantages and which is inexpensive and relatively simple. Furthermore, there is a need for a simple and inexpensive athletic training device which is capable of simulating the movements of an opposing player in a defensive or offensive posture anywhere on the playing surface while not restricting the movements of the athlete in training and allowing the athlete to perfect his or her stick handling skills.

SUMMARY OF THE INVENTION

An object of the present invention is to provide an improved athletic training device.

In accordance with one aspect of the present invention there is provided an apparatus for training athletes including a mobile carriage; means for pivotally connecting and locking an opponent simulator to the mobile carriage which permits the oscillating transverse movement of the opponent simulator; and, means for locking the carriage at a desired position on the playing surface.

In accordance with an embodiment of the present invention there is provided an apparatus for training athletes wherein the mobile carriage includes two frames, whose bottom ends are open, which frames are positioned upright and adjacent to each other and are attached to each other by structural cross-members.

In another embodiment of the present invention the said frames include a front upright member parallel to a rear upright member; said front upright member being shorter than the said rear upright member; a horizontal member which is connected to the top of the rear upright member; and, an inclined member which is connected between the said horizontal member to the front upright member.

In a further embodiment of the present invention the said inclined member is inclined at such an angle that when the training device is in operation, the opponent simulator is the proper distance from the carriage to simulate an opposing player. For example, in the case of a hockey stick, the angle of inclination ensures that the blade of the hockey stick would be parallel to a playing surface.

In still a further embodiment of the present invention the framing members are manufactured from resilient and lightweight materials such as wood, hollow structure steel tubing, aluminium tubing and the like.

In yet a further embodiment of the present invention the carriage is made mobile by mounting it on wheels or castors for operating on grass or concrete playing surfaces, or blades for operation on ice surfaces. The wheels and castors include means for locking them and the bottom of the carriage mounts retractable pins which are engageable to penetrate into to grass surfaces or provide additional resistance to movement on ice and concrete surfaces.

In an another embodiment of the present invention the means for pivoting the opponent simulator comprises a bearing assembly to which a spindle is rotatably mounted. To the spindle is fixed a mounting and locking device to mount and lock the opponent simulator in the desired location. The mounting and locking device comprises a segment of tubing manufactured from structural steel or aluminium in which the handle of the opponent simulator is mounted and through which is threaded an adjustable screw. When the screw is tightened into the tube segment, it will hold the opponent simulator firmly in position. In operation, the pivot means is capable of imparting a transverse oscillatory motion to the opponent simulator. Furthermore, it is anticipated that the means for pivoting be adjustable so that the speed or frequency of the transverse oscillatory motion can be controlled.

Advantages of the present invention are that it provides for an inexpensive and portable athletic mechanical training device which is capable of simulating the movements of offensive and defensive players to improve stick handling skills of the athlete by requiring the athlete to play through the opposing player.

BRIEF DESCRIPTION OF DRAWINGS

The present invention will be further understood from the following description with references to the drawings in which.

DETAILED DESCRIPTION

Figure 1:
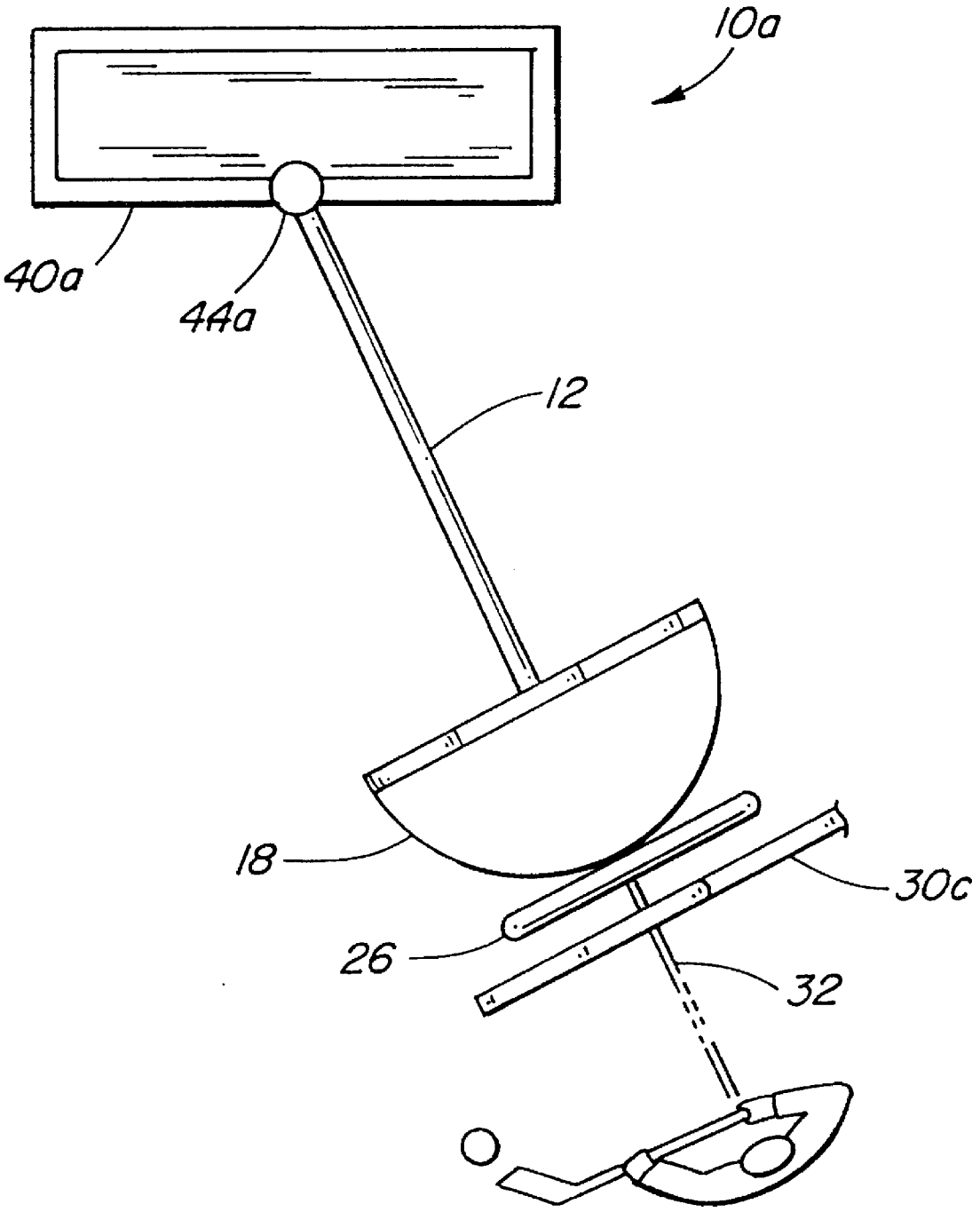
FIG. 1 illustrates an example of a known art athletic training device.

In the known apparatus, as shown in FIG. 1, the primary aim of the apparatus is to block the view of the athlete and thereby frustrate his or her attempts to score a goal.

Figure 2:
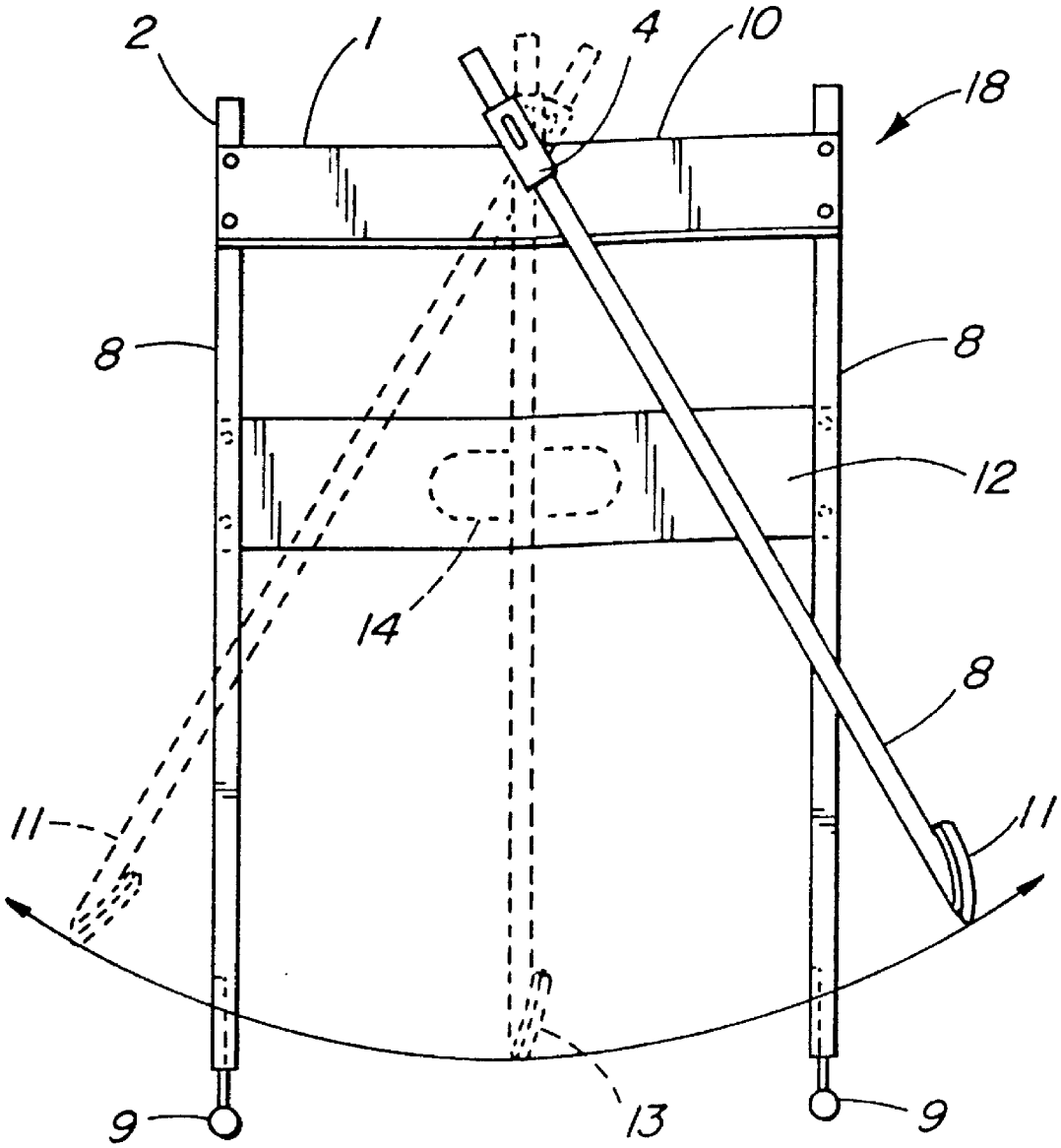
FIG. 2 illustrates a front view of one embodiment of the present invention.

Referring to FIG. 2, there is illustrated a front view of a mechanical athletic training device (1) in accordance with one embodiment of the present invention including a mobile carriage (2) to which is fixed an adjustable means for pivoting (4) and an opponent simulator (6) which is attached to the adjustable means for pivoting. The mobile carriage (2) comprises two adjacent and parallel polygonal frames (8) which are spaced apart and joined together by front cross-member (10), rear cross-member (28—not shown) and rear cross-member (12) all of which are adjustable to vary the distance between the frames. It is contemplated that the width of the mechanical athletic training device is adjustable to simulate the varying stances and leg widths of an opposing player. In a preferred embodiment of the present invention the rear cross-member is apertured (14) to facilitate lifting and moving of the apparatus. In another embodiment of the present invention the cross-members are fixed to the frames by nuts and bolts (16), although it is understood that the framing members may be fixed by screws, welds and other similar means for fastening. The opponent simulator (6) is capable of a transverse oscillating movement as illustrated in FIG. 2 which shows the upper (11) and lower (13) positions of the swinging opponent simulator. In a preferred embodiment of the present invention, the angle of swing of the opponent simulator is 30 degrees from the vertical or lower (13) position. The motion of the swinging opponent simulator is imparted by either a player striking the opponent simulator in either direction; an operator imparting the oscillating movement of the opponent simulator by way of a means for manually actuating the pivoting means (4) or by an electrically driven means for actuating affixed to the means for pivoting (4). In another embodiment of the present invention, the pivoting means is adjustable so that the speed and frequency of the movement of the opponent simulator is variable to simulate the movements of an opposing player. It is further contemplated in another embodiment of the present invention that the carriage be mobile by the fixing of lockable wheels (9) or casters to the bottom four corners of the carriage (2). Alternatively, it is contemplated, that, for use on ice surfaces, the carriage can be fitted with skate blades.

Figure 3:
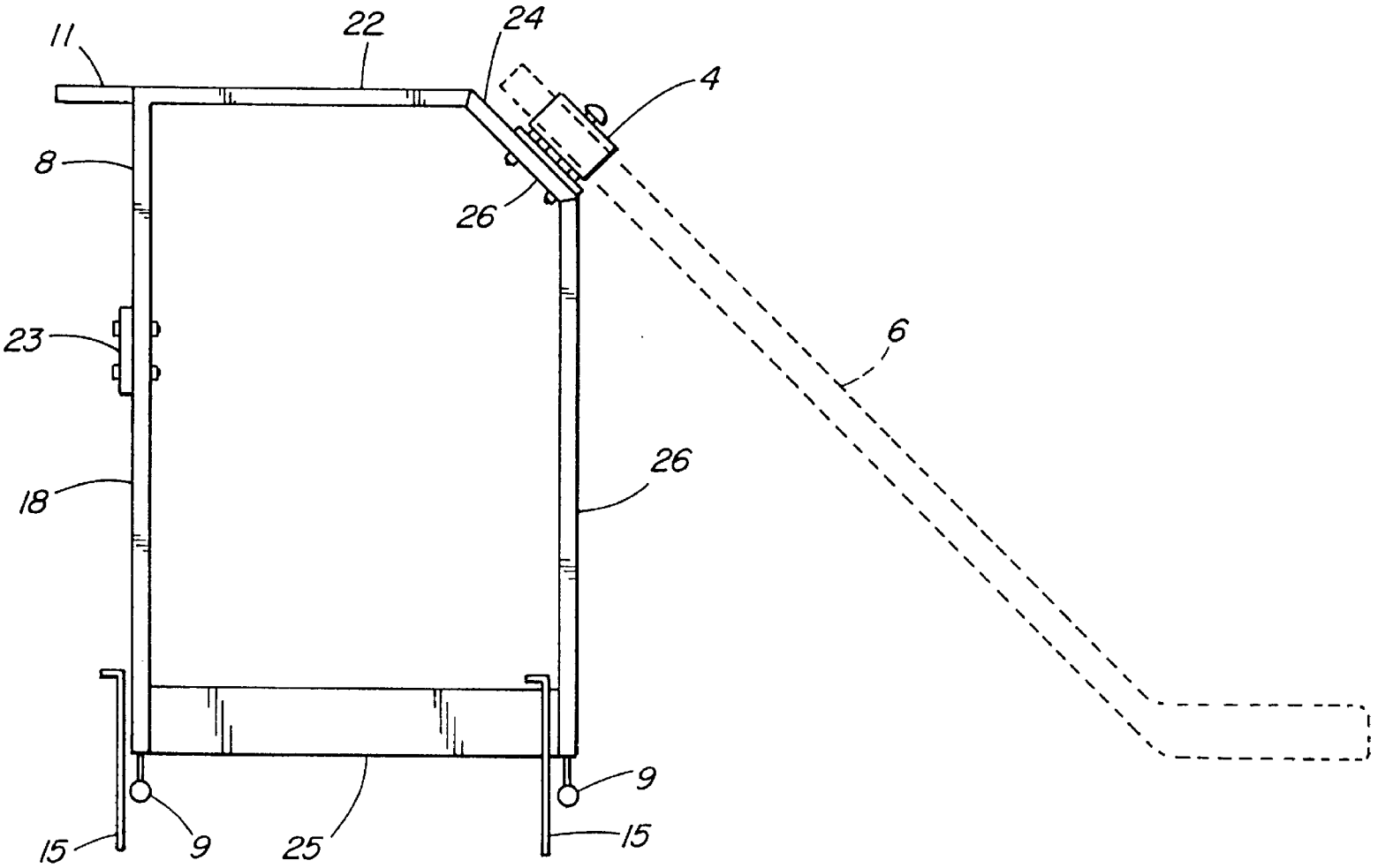
FIG. 3 illustrates a side view of one embodiment of the present invention.

Referring to FIG. 3, there is illustrated a side view of one embodiment of the present invention. Polygonal frame (8) includes a rear upright member (18), a front upright member (20), a horizontal member (22) attached to the top of rear upright member (20) and an inclined member (24) which is attached between the horizontal member (22) and the front upright member (20). The bottom end (25) of frame (8) is open. The framing members (18, 20, 22 and 24) are attached to each other by means of either brackets, nuts and bolts, dowels, screws or welds or other suitable means for attaching. The frames are separated and attached to each other by adjustable rear cross-member (23), an adjustable front cross-member (26) and a bottom-side cross members (25). The frames are further attached to each other by way of cross framing member (28—not shown). Adjustable means for pivoting (4) is shown attached to the inclined front cross-member (26). The simulated opponent (6), in this embodiment shown as a hockey stick, is attached to means for pivoting (4). In another embodiment of the present invention it is contemplated that an operator be able to move the mobile carriage to simulate the movements of an opposing player and therefore, to facilitate this, handles (11) are attached to the top of frames (8). In a static position, the mechanical athletic training device is held in position by locks on the wheels or castors (9). However, in a further embodiment of the present invention, it is contemplated that spring-biased retractable locking pins (15) are attached to the bottom four corners of the frames (8) to help to anchor the training device in a static position.

Figure 4:
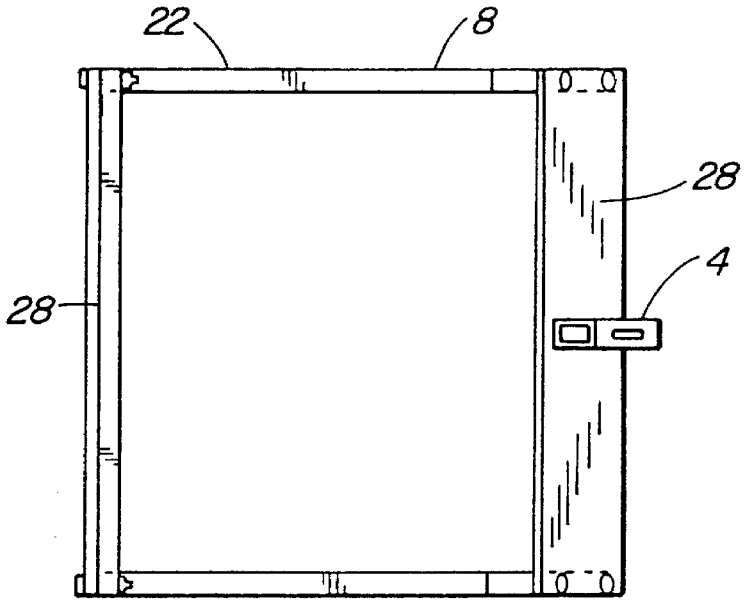
FIG. 4 illustrates a top view of one embodiment of the present invention.

Referring to FIG. 4, there is illustrated a top view of one embodiment of the present invention. The top of framing members (8) are shown comprising horizontal member (22) and inclined member (24). The inclined front cross-member

(26) is shown attached to the inclined members (24) of the frames (8). Means for pivoting (4) is shown mounted on the front cross-member (26) midway between the two frames (8). Framing member (28) is shown connecting the back of the frames (8) for added rigidity.

Figure 5:
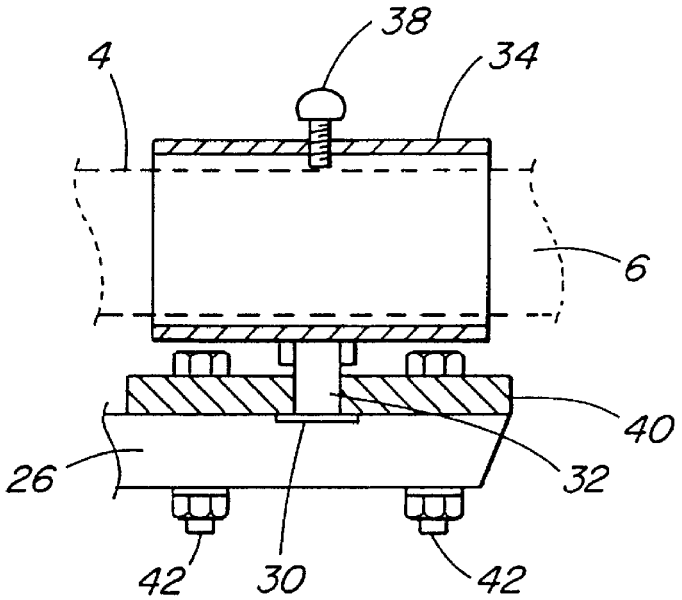
FIG. 5 illustrates a view of the means for pivoting of one embodiment of the present invention.

Referring to FIG. 5, there is shown the means for pivoting (4) of one embodiment of the present invention. The means for pivoting (4) comprises a bearing (30) housed in mounting flange (40). Spindle (32) is rotatably mounted to bearing (30). Spindle (32) is in turn attached to a mounting and locking device (34) which holds the simulated opponent (6) in place. The mounting and locking device (34) is manufactured from tubular steel or aluminium or similar suitable material. Locking screw (38) is mounted to the locking device (34) and located such that the locking screw (38) is coaxial with the spindle (32). The mounting flange (40) is attached to front cross-member (26) by a nut and bolt set (42). In a further embodiment of the present invention it is contemplated that the bearing (30) and spindle (32) assembly is tensionable to vary the speed and frequency of the opponent simulator.

Figure 6:
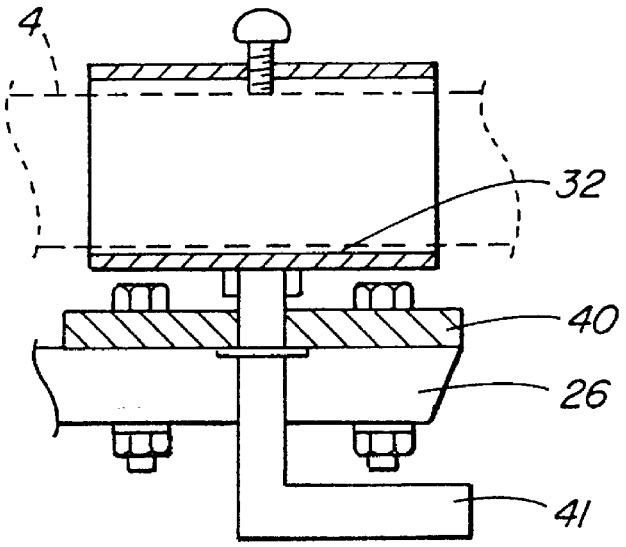
FIG. 6 illustrates a view of the means for pivoting plus handle of one embodiment of the present invention.

Referring to FIG. 6, which shows another embodiment of the present invention, it will be appreciated that the means for pivoting (4) can alternatively include an elongated spindle (32) which is of sufficient length to penetrate the flange (40) and front cross-bracket (26) to facilitate the mounting of means (41) to manually impart a transverse oscillatory movement to the simulated opponent.

Figure 7:
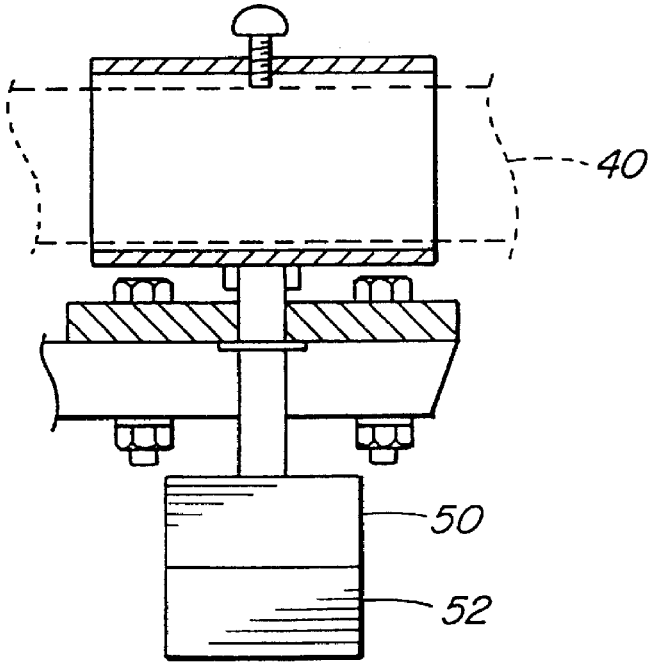
FIG. 7 illustrates a view of the means for pivoting plus electric motor and transmission of one embodiment of the present invention.

FIG. 7 shows another embodiment of the present invention, in which an electric motor (52) is attached to a transmission (50) to impart a transverse oscillatory motion to the opponent simulator.

Figure 8:
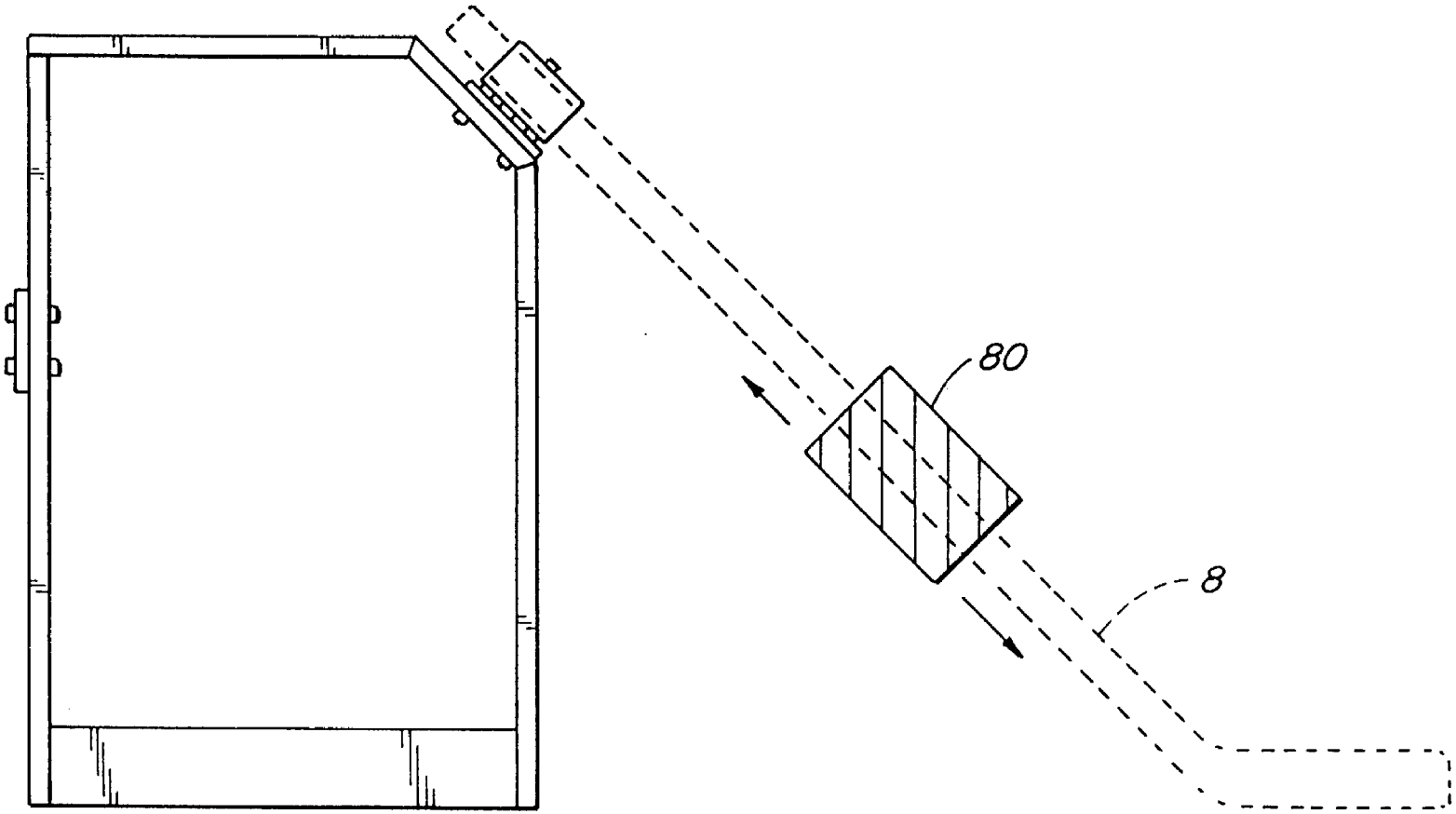
FIG. 8 illustrates a view of one embodiment of the present invention with a slidable collar on the opponent simulator.

Referring to FIG. 8, and in yet a further embodiment of the present invention, the transverse oscillatory motion can be imparted to the opponent simulator by way of the athlete striking it, a weighted slidable collar attachment can be placed over the handle of the opponent simulator to increase or decrease the resistive force and reactive force of the opponent simulator.

Numerous modifications, variations, and adaptations may be made to the particular embodiments of the invention described above without departing from the scope of the invention, which is defined in the claims.

What is claimed is:

1. An apparatus for training athletes on a playing surface, said apparatus comprising:

a mobile carriage;

an opponent simulator;

means for pivotally connecting and securing said opponent simulator to said carriage;

means for permitting movement of said opponent simulator in an oscillating transverse fashion; and, means for locking said carriage in a desired location on a playing surface.

2. An apparatus as claimed in claim 1, wherein said mobile carriage includes at least two frames which are positioned generally upright and adjacent in spaced-apart relation to each other and wherein said mobile carriage further includes a plurality of structural cross-members attaching said frames to each other.

3. An apparatus as claimed in claim 2, wherein said frames each include:

a front upright member in spaced-apart relationship to a rear upright member, said front and rear upright members being parallel to each other;

said front upright member being shorter than said rear upright member;

a horizontal member extending frontwardly from a top portion of said rear upright member;

an inclined member extending from a front end of said horizontal member to a top portion of said front upright member; and, means for connecting all said members to each other.

4. An apparatus as claimed in claim 3, wherein said frame members are manufactured from a group of resilient and lightweight materials that includes wood, plastic, hollow structure steel tubing, aluminium tubing and the like.

5. An apparatus as claimed in claim 2, wherein said upright and adjacent frames are parallel to each other.

6. An apparatus as claimed in claim 5, wherein said carriage includes means for adjusting the distance between said frames.

7. An apparatus as claimed in claim 6, further comprising mobility means for operating said apparatus on grass or concrete playing surfaces and permitting said apparatus to be easily moved from one location to another.

8. An apparatus as claimed in claim 7, wherein said mobility means comprises blades.

9. An apparatus as claimed in claim 1, wherein said means for locking comprises spring-biased, retractable pins to fix said carriage to grass surfaces and provide additional resistance to movement on ice and concrete playing surfaces.

10. An apparatus as claimed in claim 9, further comprising means for operator handling and moving said carriage and mounted to said carriage, said means for handling and moving said carriage projecting rearwardly from a top-rear portion of each of said frames.

11. An apparatus as claimed in claim 1, where said means for pivotally connecting and securing said opponent simulator to said carriage comprises:

a bearing means;

a spindle assembly rotatably mounted in said bearing means;

means for mounting and securing said opponent simulator to said spindle assembly;

said means for mounting and securing said opponent simulator to said spindle assembly comprising a tubular metal segment in which a handle portion of said opponent simulator is placed and through which is threaded an adjustable screw which, when tightened into said tubular segment, compresses said handle portion of said opponent simulator to an inside wall of said tubular segment thus holding said opponent simulator firmly in position.

12. An apparatus as claimed in claim 11, wherein said bearing assembly includes a means for adjusting the rotational speed of said spindle assembly.

13. An apparatus as claimed in claim 11, wherein said spindle assembly includes a handle means extending toward a rear portion of said bearing assembly.

14. An apparatus as claimed in claim 13, wherein said spindle assembly is driven by an electric motor.

15. An apparatus as claimed in claim 1, wherein a slidable, weighted collar is placed on a handle portion of said opponent simulator and by moving said weighted collar up and down said handle portion of said opponent simulator it has the effect of increasing or reducing the resistance to movement and reactive force of said opponent simulator.

16. A method of athletic training comprising the steps of:

providing a mechanical athletic training device having an opponent simulator pivotally mounted on a mobile carriage, the mechanical athletic training device further including means for locking the mobile carriage in place on a playing surface;

positioning the mobile carriage at a desired location on a playing surface;

adjusting the opponent simulator such that it is in the appropriate position to simulate an opposing player;

locking the position of the mobile carriage on the playing surface using the locking means;

imparting a transverse oscillatory motion to the opponent simulator; and requiring the athlete to attempt to defeat the moving opponent simulator by judging and anticipating the oscillating movements of the opponent simulator and then playing through the opponent simulator and the mobile carriage.

17. A method as claimed in claim 16 further comprising the step of grasping the opponent simulator and imparting an additional movement to the carriage as an athlete attempts to defeat the opponent simulator.

* * * * *